US005215274A

United States Patent [19]

Lin

[11] Patent Number: 5,215,274

[45] Date of Patent: Jun. 1, 1993

[54] SUPPORTING DEVICE FOR TOILET TISSUE

[76] Inventor: Wen-Yi Lin, No. 62, Hsinan Chuang, Fushan Li, Changhua City, Taiwan

[21] Appl. No.: 766,501

[22] Filed: Sep. 27, 1991

[51] Int. Cl.[5] ..... B65H 16/06

[52] U.S. Cl. ..... 242/55.2

[58] Field of Search ..... 242/55.2, 68.4, 55.53

[56] References Cited

U.S. PATENT DOCUMENTS

| | | | |
|---|---|---|---|
| 1,069,961 | 8/1913 | Kuczynski | 242/55.2 |
| 1,117,342 | 11/1914 | Currie | 242/55.2 |
| 1,523,491 | 1/1925 | Rast | 242/55.2 |
| 2,369,970 | 2/1945 | McClearen | 242/55.2 |
| 2,370,821 | 3/1945 | Stott | 242/55.2 |
| 2,917,249 | 12/1959 | MacLelland | 242/55.2 |
| 4,285,474 | 8/1981 | Perez | 242/55.2 |
| 4,381,083 | 4/1983 | Tsunetsuga | 242/55.2 |

FOREIGN PATENT DOCUMENTS 0342951 11/1989 European Pat. Off. ..... 242/55.2

*Primary Examiner*—Daniel P. Stodola
*Assistant Examiner*—Paul Bowen
*Attorney, Agent, or Firm*—Lalos & Keegan

[57] ABSTRACT

A device including two plates fixed to a wall, a member fixed to each of the plates, a roller rotatably supported between the members, a helical groove formed in one of the members and having a channel communicated between the end portions of the helical groove, an oblong hole formed in one end of the roller, a guide slidably engaged in the oblong hole and having one end slidably engaged in the helical groove, the guide being caused to move along the helical groove when the toilet tissue is pulled by a user and being movable back to the initial position via the channel.

3 Claims, 4 Drawing Sheets

SUPPORTING DEVICE FOR TOILET TISSUE

BACKGROUND OF THE INVENTION

1. Field of the Invention

The present invention relates to a supporting device, and more particularly to a supporting device for toilet tissue.

2. Description of the Prior Art

One type of supporting device is provided for rotatably supporting a roll of toilet tissue. However, generally, it is required for the user to use one of his hands to press the toilet tissue and to tear the toilet tissue with his other hand. The toilet tissue is rotatably supported in place and cannot be stopped when it is required to be torn.

The present invention has arisen to mitigate and/or obviate the afore-described disadvantages of the conventional supporting devices for toilet tissue.

SUMMARY OF THE INVENTION

The primary objective of the present invention is to provide a supporting device for supporting a toilet tissue in which the toilet tissue can be stopped after it has been pulled for a suitable length.

In accordance with one aspect of the invention, there is provided a supporting device for a roll of toilet tissue including a pair of plates fixed to a wall, a first member fixed to one of the plates and having a slot formed therein, a second member fixed to the other plate and including a dent formed therein and a helical groove formed around the dent, a channel communicated between the end portions of the helical groove, a roller including a disc formed integral on one end for engagement in the slot of the first member and a cap fixed to the other end, the cap including an axle for engagement in the dent of the second member so that the roller can be rotatably supported by the members, the toilet tissue being engaged on the roller, the cap having an oblong hole formed therein, a guide slidably engaged in the oblong hole and having one end slidably engaged in the helical groove, the guide being caused to move along the helical groove from the one end to the other when the toilet tissue is pulled by a user, and the guide being movable back to the initial position via the channel.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
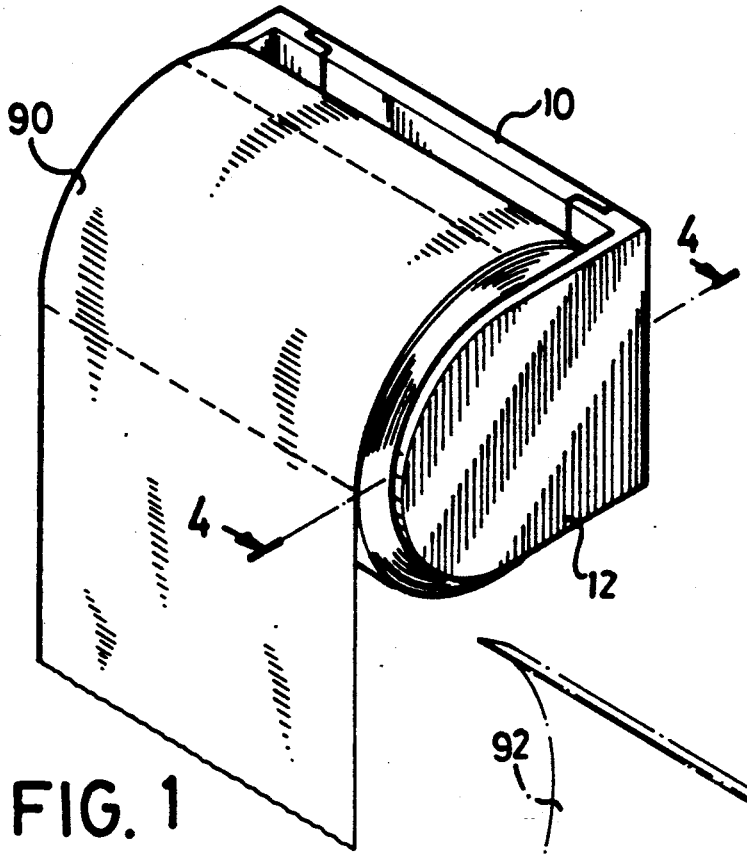
FIG. 1 is a perspective view of a supporting device in accordance with the present invention.

Referring to the drawings and initially to FIG. 1, a supporting device in accordance with the present invention is generally provided for rotatably supporting a roll of toilet tissue 90.

Figure 2:
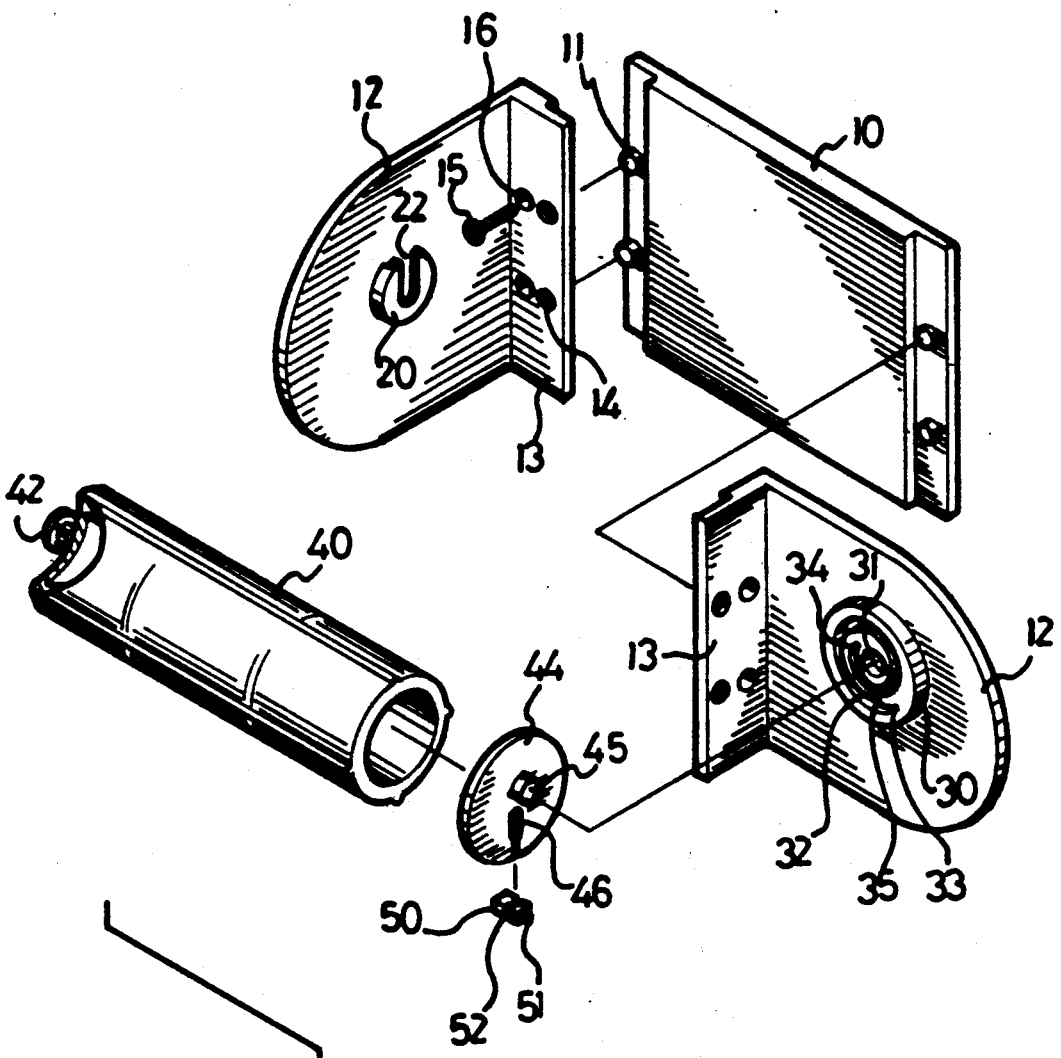
FIG. 2 is an exploded view of the supporting device for toilet tissue.
Figure 3:
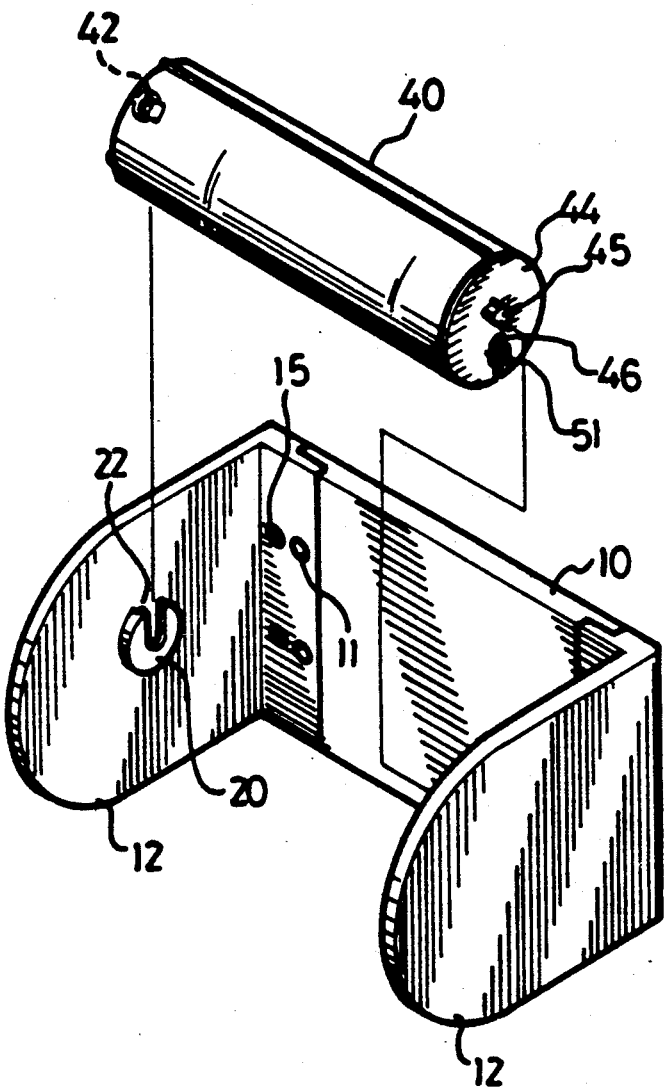
FIG. 3 is a partial exploded view of the device.
Figure 4:
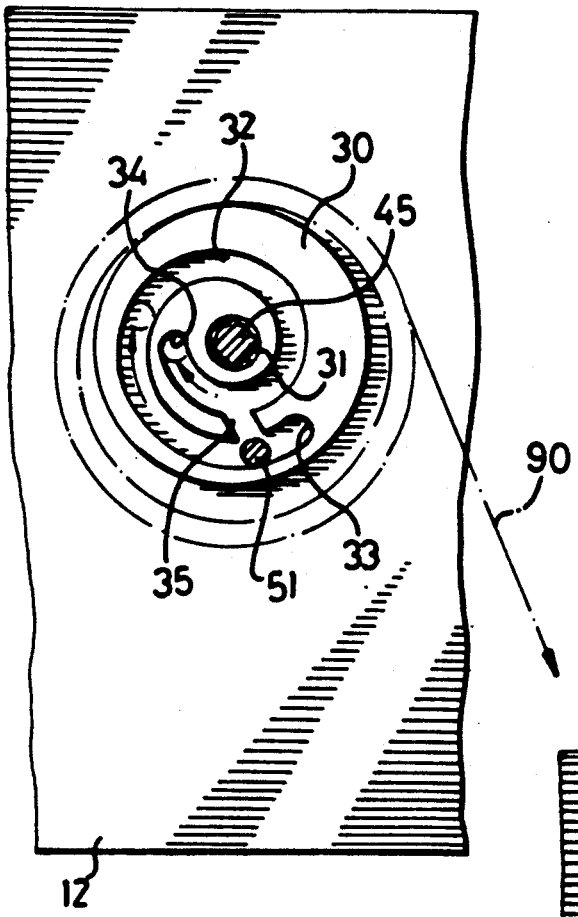
FIGS. 4 and 5 are cross sectional views taken along lines 4—4 of FIG. 1.

Referring next to FIGS. 2, 3 and 4, the supporting device comprises a panel 10 having two protrusions 11 formed on each side thereof, a pair of plates 12 each having a flange 13 perpendicularly extended therefrom, two orifices 14 formed in each of the flanges 13 for engagement with the protrusions 11 of the panel 10, and two apertures 16 formed in each of the flanges 13 so that the plates 12 and the panel 10 can be fixed to the wall by such as screws 15. A first member 20 is fixed in one of the plates 12 and includes a slot 22 formed therein and opened upward.

A second member 30 is fixed in the other plate 12 and includes a dent 31 formed in the center and a helical groove 32 formed around the dent 31. The groove 32 includes a first end 33 located in a radially inward position and a second end 34 located in a radially outward position. A channel 35 is communicated between the end portions of the groove 32 and is preferably slightly inclined.

A roller 40 has a disc 42 formed integral on one end thereof for rotatable engagement in the slot 22 of the first member 20 and has a cap 44 fixed to the other end by such as force-fitted engagement. The cap 44 includes an axle 45 formed integral on one side thereof and rotatably engaged in the dent 31 of the second member 30 so that the roller 40 can be rotatably supported by the members 20, 30, and an oblong hole 46 formed therein. The toilet tissue 90 is disposed on the roller 40 and rotates in concert with the roller 40. A guide 50 includes a shaft 51 extended therefrom and a pair of recesses 52 formed therein so that the guide 50 can be slidably engaged in the oblong hole 46 of the cap 44. The shaft 51 is slidably engaged in the groove 32 of the second member 30.

As shown in FIG. 4, when the toilet tissue 90 is pulled by a user, the shaft 51 is caused to move along the groove 32 from the first end 33 to the second end 34. The roller 40 is stopped and can not be rotated when the shaft 51 reaches the second end 34 of the groove 32 so that a suitable length of the toilet tissue can be pulled out. Accordingly, the toilet tissue can be torn with only one hand.

Figure 5:
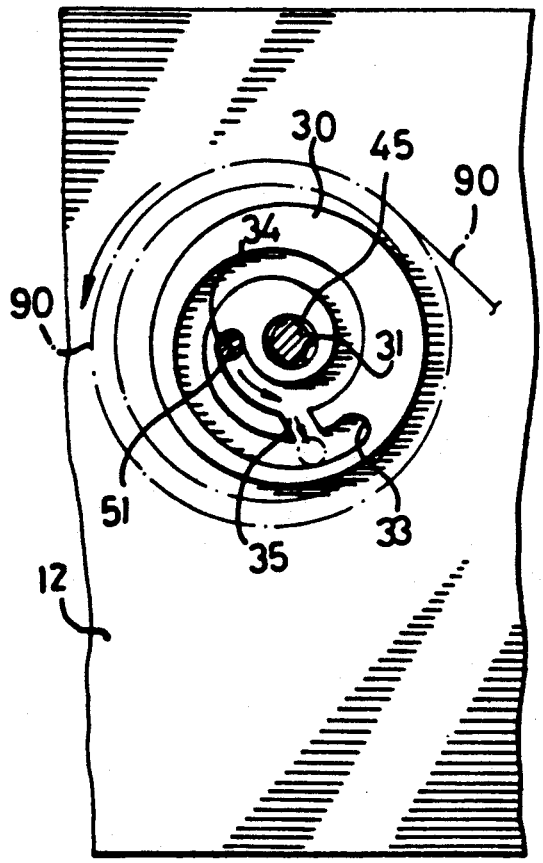

As shown in FIG. 5, when the toilet tissue has been torn and when the toilet tissue is not pulled by the user, the shaft 51 will move back, due to gravity, along the groove 32 and will move back to the first end 33 via the channel 35 so that the toilet tissue will rotate counterclockwise. At this moment, the free end portion of the toilet tissue will move to the inner portion close to the panel 10 and will fall down so that the free end portion of the toilet tissue has a predetermined length depending downward therefrom, as shown in FIG. 1, and so that the toilet tissue is ready for next use.

Figure 6:
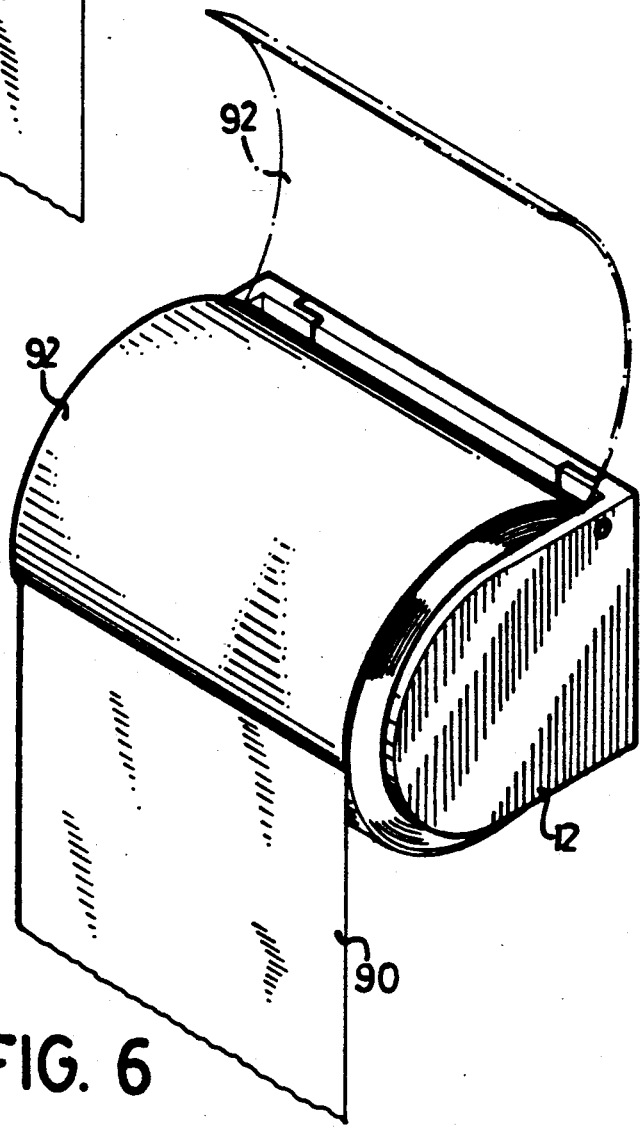
FIG. 6 is a perspective view illustrating another embodiment of the present invention.

Referring next to FIG. 6, a cover 92 which is slightly curved can be pivotally provided on the upper portion of the supporting device for covering the toilet tissue.

Accordingly, the supporting device in accordance with the present invention can support a roll of toilet tissue which can be stopped after it has been pulled for a suitable length so that the toilet tissue can be torn with only one hand.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A supporting device for a roll of toilet tissue comprising a pair of plates fixed to a wall, a first member fixed to one of said plates and having a slot formed therein, a second member fixed to the other plate and including a dent formed therein and a helical groove formed around said dent, said helical groove including a first end located in a radially inward position and a second end located in a radially outward position, a channel communicated between said first end and said second end of said helical groove, a roller including a disc formed integral on one end thereof for engagement in said slot of said first member and a cap fixed to the other end thereof, said cap including an axle formed thereon for engagement in said dent of said second member so that said roller can be rotatably supported by said first member and said second member, said toilet tissue being engaged on said roller, said cap having an oblong hole formed therein, a guide slidably engaged in said oblong hole and having one end slidably engaged in said helical groove, said guide being caused to move along said helical groove from said first end of said helical groove to said second end of said helical groove when said toilet tissue is pulled by a user, and said guide being movable from said second end of said helical groove to said first end of said helical groove via said channel.

2. A supporting device according to claim 1, wherein said guide includes a shaft extended therefrom for slidably engagement with said helical groove of said second member, and a pair of recesses formed therein for engagement with said oblong hole of said cap so that said guide is movable along said oblong hole.

3. A supporting device according to claim 1, wherein a panel includes two sides each having at least one protrusion formed thereon, each of said plates includes a flange perpendicularly extended therefrom, each of said flanges has at least one orifice formed therein for engagement with said protrusion and has at least one aperture formed therein, a screw engages in each of the apertures so that said plates and said panel can be fixed to said wall.

* * * * *